US005368078A

United States Patent [19]

Rupe

[11] Patent Number: 5,368,078

[45] Date of Patent: Nov. 29, 1994

[54] FINGER JOINT CUTTER BLADE

[75] Inventor: Lawrence A. Rupe, Boise, Id.

[73] Assignee: Ace Company, Inc., Boise, Id.

[21] Appl. No.: 200,652

[22] Filed: Feb. 23, 1994

[51] Int. Cl.[5] ..... B27F 1/16

[52] U.S. Cl. ..... 144/234; 144/90 A; 144/218; 407/110; 407/118

[58] Field of Search ..... 409/31, 33, 110, 118; 144/90 R, 90 A, 218, 230, 234, 231, 232, 233, 235

[56] References Cited

U.S. PATENT DOCUMENTS

| | | | |
|---|---|---|---|
| 362,625 | 5/1887 | Jewit . | |
| 1,099,880 | 6/1914 | Kendall . | |
| 1,265,501 | 5/1918 | Payzant . | |
| 1,718,325 | 6/1929 | Weaver | 144/234 |
| 1,903,002 | 3/1933 | Johnson . | |
| 2,449,605 | 9/1948 | Kelton | 144/230 |
| 3,126,308 | 3/1964 | Brockerman et al. | 156/380 |
| 3,388,020 | 6/1968 | Gates | 156/266 |
| 3,480,054 | 11/1969 | Marian | 144/317 |
| 3,576,200 | 4/1971 | Elmes | 407/118 |
| 3,894,322 | 7/1975 | Pano | 407/110 |
| 3,951,189 | 4/1976 | Cromeens | 144/91 |
| 4,068,688 | 1/1978 | Benson | 144/90 A |
| 4,558,974 | 12/1985 | Pano | 407/110 |
| 4,833,855 | 5/1989 | Winter | 52/592 |
| 5,005,619 | 4/1991 | Jensen | 144/230 |
| 5,054,967 | 10/1991 | Noguchi et al. | 407/110 |

OTHER PUBLICATIONS

"Rotating Tools and Inserts" Catalog by Snadvik Coromant, p. 128.

*Primary Examiner*—W. Donald Bray

*Attorney, Agent, or Firm*—Frank J. Dykas; Craig M. Korfanta; Margaret M. Dunbar

[57] ABSTRACT

A cutter blade (17) for a finger joint cutter head (10) which includes a cantilevered cutting tip attachment. A cantilever pocket (20) is formed in the fillet area of steel backing member (18) to receive and hold the inner end of a hard material cutting tip (19), such as tungsten carbide. Cantilever pocket (20) has tapered sides which diverge outwardly and a rounded vertex or pocket bottom. Cutter tips are elongated to extend well into cantilever pockets (20). Each cutter tip is attached within a pocket (20) and along the joint surface of steel backing members (18), using a sandwich braze, to form braze joints (21) and (22).

16 Claims, 5 Drawing Sheets

FINGER JOINT CUTTER BLADE

BACKGROUND OF THE INVENTION

1. Technical Field

This invention generally relates to finger joint cutter heads which are mounted on a rotatable shaper spindle, such that the cutter head cuts finger joints in the edges of wood products for joining two such products together. More particularly, this invention relates to a cutter blade for use in a finger joint cutter head. Cooperating finger joint cuts are used to join two pieces of material, generally wood, together to form one continuous larger piece. Finger joint cutting is an economical process to produce a long piece from a number of short pieces by providing matching or cooperating surfaces at the ends of the pieces which can be fitted together and glued.

2. Background

U.S. Pat. No. 3,951,189 to Cromeens, incorporated herein by reference, discloses an apparatus for carrying out this process. Generally, a finger joint cutter head is mounted on the spindle of a shaper apparatus through which the shorter pieces of material are fed.

U.S. Pat. No. 5,005,619 to Jensen, also incorporated herein by reference, discloses the details of the construction of several cutter heads. Generally speaking a plurality of individual claw-shaped cutter blades are stacked one on top of another to form cutter blade assemblies which in turn are annularly secured via bolts between the top and bottom plate of the cutter head. The top and bottom plates are attached in parallel spaced relation to an arbor collar. The top and bottom plates extend radially outward from the arbor collar.

Initially, the individually cutter blades were simply machined from a high speed tool steel. The actual cutting surface or tip was simply a ground surface of the tool steel. These blades had a very limited life and had to be regularly sharpened because of the high speed, high temperature and abrasive nature of their use.

In response to this problem, harder cutting surfaces or tips, such as tungsten carbide, were attached to the cutter blade to serve as the actual cutting surface. FIG. 2 of the drawings illustrates this prior art cutter blade, generally designated as one. Prior art cutter blade 1 has a high speed tool steel backing 2 to which carbide tip 3 is attached via a silver alloy braze joint 4, or other suitable attachment mechanism. As can be seen from FIG. 2, the innermost end of carbide tip 3 is rounded to mate with the fillet on backing 2. This cutter blade configuration represents the current state of the art.

While this cutter blade demonstrates tremendous improvement over the previous all steel cutter since it does not require the frequent resharpening, it is still prone to failure. Because of the different expansion coefficients of the carbide material and steel backing, a carbide tip must be carefully attached to the steel backing. This is especially true since heat is generally used to accomplish the attachment process, as in brazing or welding. Currently, a copper strip which is clad on both sides with a silver alloy braze material is used to bond the carbide tip to the steel backing. This so called "sandwich" braze helps prevent bond failure or cracking of the carbide as the two distinct materials are cooled at the end of the brazing process. The copper strip acts as a mechanical stress buffer.

As can readily be seen from FIG. 2, the area of carbide tip 4 which is actually bonded to steel backing 2, this surface of the backing member is hereinafter referred to as the cutter tip attachment surface, is approximately equal or slightly greater than the actual cutting surface presented by the blade. This is unfortunate in that virtually all of the force generated during cutting is transferred through the braze joint to steel backing 2. This fact, when coupled with the high temperatures generated during the cutting process, results in an unacceptably high failure rate of the cutter blades.

What is needed is a cutter blade for finger joint cutting which does not require frequent sharpening and which prolongs the life of the cutter blades. It is, therefore, an object of this invention to provide a carbide tipped, or other hard material tipped, finger joint cutter blade which is not as susceptible to failure.

DISCLOSURE OF INVENTION

This object, and others, are accomplished by a cutter blade for a finger joint cutter head which includes a cantilevered cutting tip attachment. A cantilever pocket is formed in the fillet area of the steel backing to receive and hold the inner end of a hardened cutting tip, such as tungsten carbide. The cantilever pocket has tapered sides which diverge outwardly and a rounded vertex or pocket bottom. The hardened cutter tip is elongated to extend well into the cantilever pocket. The hardened tip is attached within the pocket and along the joint surface of the steel backing, using the sandwich braze process explained earlier. Other suitable attachment processes will work.

It should be noted that it is possible to use other materials for both the cutter blade backing and the hardened cutter tips. While tungsten carbide is the currently preferred material for the cutter tips, it is possible to use diamond treated steel tips, ceramic composition tips, etc. Additionally, it is possible to attach multiple cutter tips to a single backing member.

BEST MODE FOR CARRYING OUT INVENTION

Figure 1:
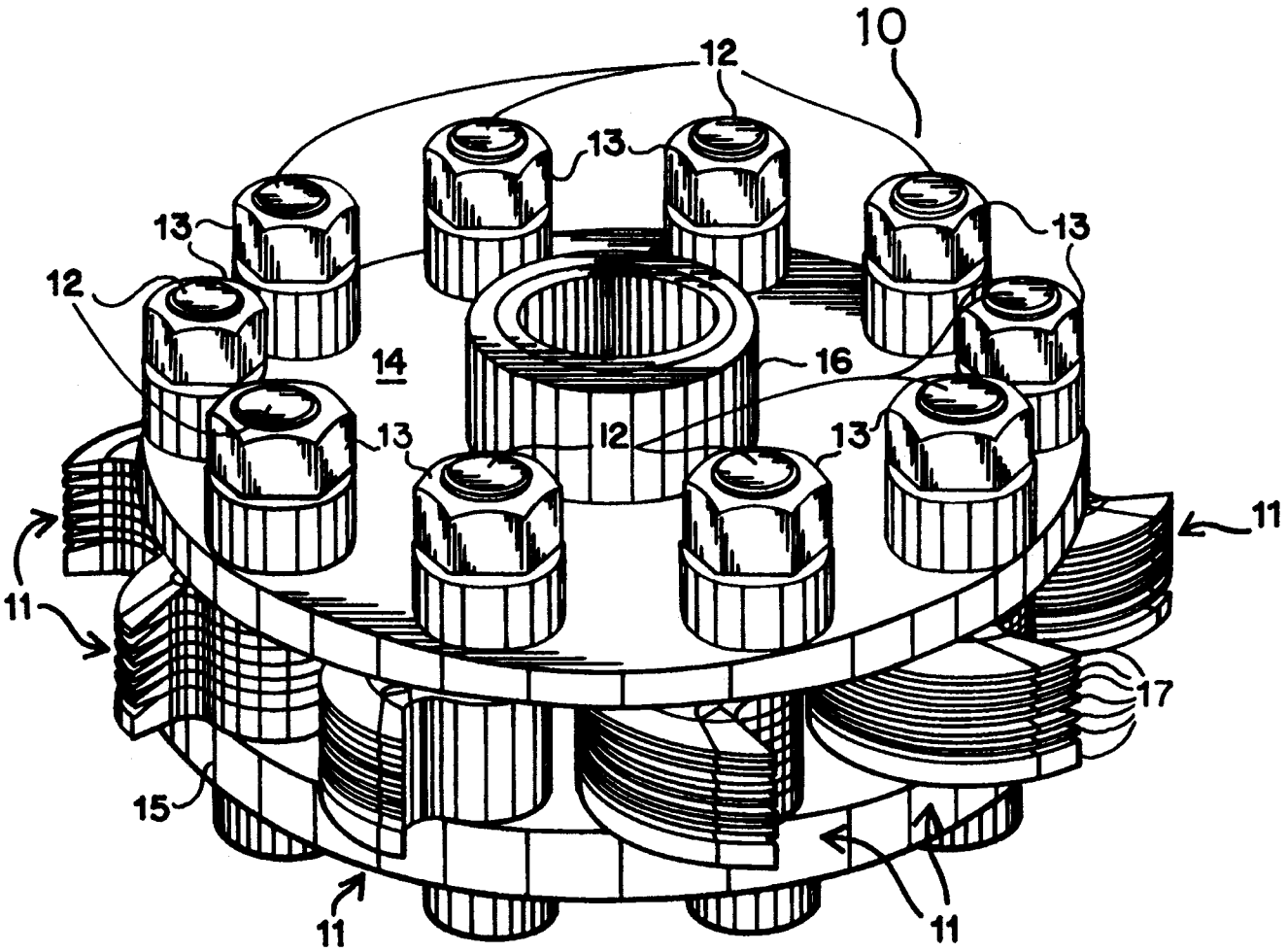
FIG. 1 is an isometric view of a ten bolt finger joint cutter head assembly.
Figure 2:
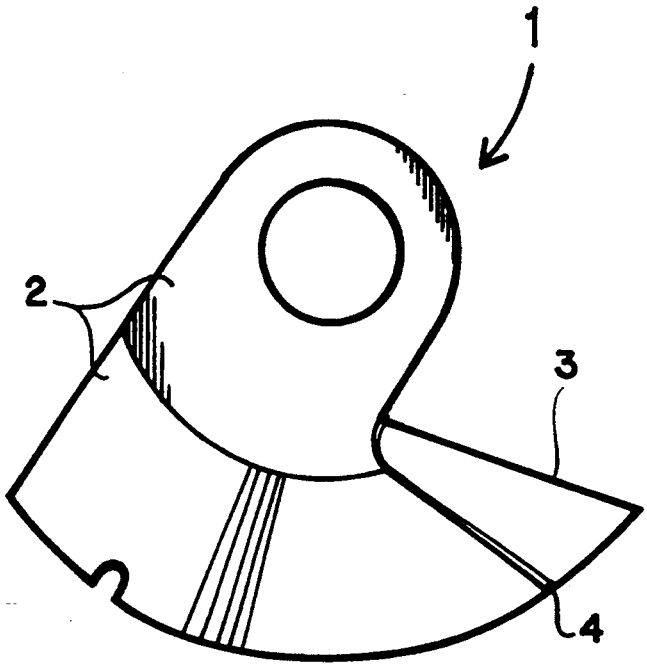
(PRIOR ART) FIG. 2
FIG. 2 is a first side view of the prior art finger joint cutter blade.
Figure 3:
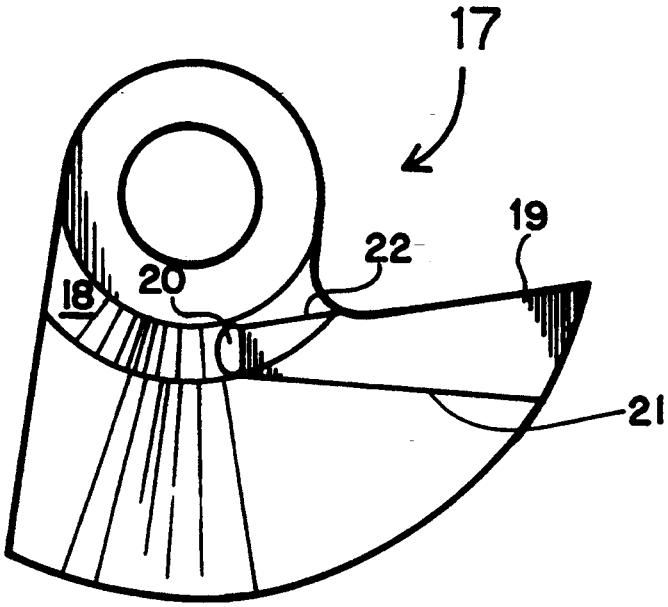
FIG. 3 is a first side view of the finger joint cutter blade according to the present invention, the second side being a mirror image of the first side.
Figure 4:
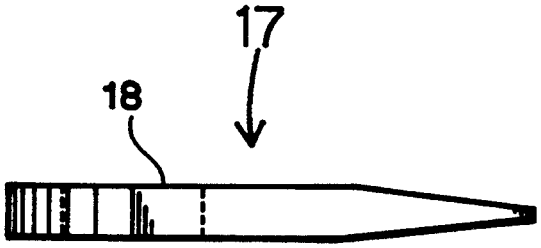
FIG. 4 is a left edge view of the cutter blade of the present invention.
Figure 5:
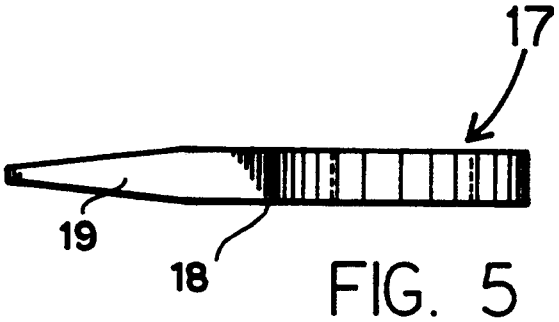
FIG. 5 is a top edge view of the cutter blade of the present invention.
Figure 6:
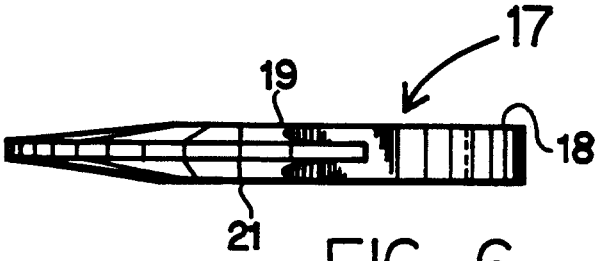
FIG. 6 is a right edge view of the cutter blade of the present invention.
Figure 7:
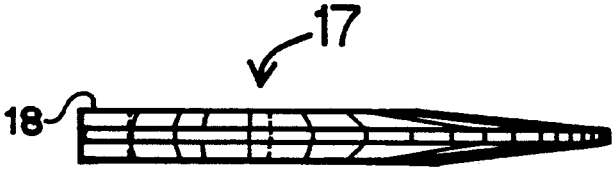
FIG. 7 is a bottom edge view of the cutter blade of the present invention.

Referring now the figures, the cutter blade of the present invention, the blade being generally designated as 17, is illustrated in detail and shown installed in a ten-bolt finger joint cutter head 10. A plurality of individual cutter blades 17 are stacked one on top of another to form cutter blade assemblies 11 which in turn are annularly secured, via bolts 12 and nuts 13, between the top plate 14 and bottom plate 15 of cutter head 10. Top and bottom plates, 14 and 15, are attached in parallel spaced relation to an arbor collar 16. The plates extend radially outward from arbor collar 16. Arbor collar 16 is used to attach cutter head 10 to the spindle of a shaper apparatus.

Each cutter blade 17 has a claw-shaped backing member 18 which is preferably machined from a high speed tool steel, however other suitable materials will work. Backing members 18 each include an aperture for receiving bolts 12 when attached to cutter head 10. Additionally, an attachment surface is provided to each backing member 18 for attachment of a cutter tip. Preferably, as is shown here, the attachment surfaces are flat and linear to facilitate bonding of the cutter tips to the backing members. The cross sections of backing members taper down from the inner thickness at the aperture to the outer marginal edge, which has a thickness approximately equal to the desired cutting thickness.

A "cantilever" pocket 20 is formed in the fillet area of each backing member 18. The actual fillet serves to break chips or slivers of material along with preventing material from collecting or building up in the area of the fillet. The radius of the fillet can be varied and even altogether eliminated if desired. The phrase "cantilever pocket", as it is used here, describes the general configuration of the portion of the backing member to which a cutter tip is attached and is not meant to accurately describe the sole support mechanism by which a cutter tip is held and secured to the backing member. Each cantilever pocket 20 preferably has a pair of outwardly diverging straight side surfaces 23 extending from a rounded pocket vertex. This configuration provides a wedge effect during the brazing and cooling processes which insures that the proper clearances and joint integrity are maintained by allowing backing member 18 and cutter tip 19 to expand and contract at different rates with respect to one another, as would be the case when different materials are used for the two components. One of the side surfaces 23 of each pocket 20 is formed co-linear and co-extensive with the attachment surface of each backing member 18. The vertex of each pocket 20 is rounded to eliminate the stress fractures normally associated with rectilinear recesses.

A hard material cutter tip 19 is attached to each backing member 18 using a suitable bonding process. Here, cutter tips 19 are made of tungsten carbide, however other materials and compositions such as diamond coated substrates, ceramics, etc. can be substituted for carbide cutter tips 19. Cutter tips 19 each include an elongated inner end which is shaped to be closely received within cantilever pockets 20. Cutter tips 19 are bonded to the sides 23 of cantilever pockets 20 and along the attachment surface of backing members 18 using a suitable bonding process. Cutter tips 19 are then ground and sharpened.

In the preferred embodiment, using a tool steel backing member and a carbide cutter tip, the preferred bonding method is a silver alloy braze which incorporates a copper buffer strip. The copper strip, which is clad with the silver alloy, is placed between cutter tip 19 and backing member 18 along the sides 25 of cantilever pocket 20 and the attachment surfaces on backing member 18. Braze zones 21 and 22 are then heated to a specific temperature to effect the joints.

The added attachment surface enabled by the present invention, along with the cantilevered support, acts to hold cutter tips 19 along opposing sides at braze joints 21 and 22, and to more effectively and evenly distribute cutting forces throughout backing members 18, thereby increasing the life and reliability of cutter blades 17.

In use, cutter blades 17 are simply substituted for prior art cutter blades 1 in the cutter head, such as ten-bolt finger joint cutter head 10.

Figure 8:
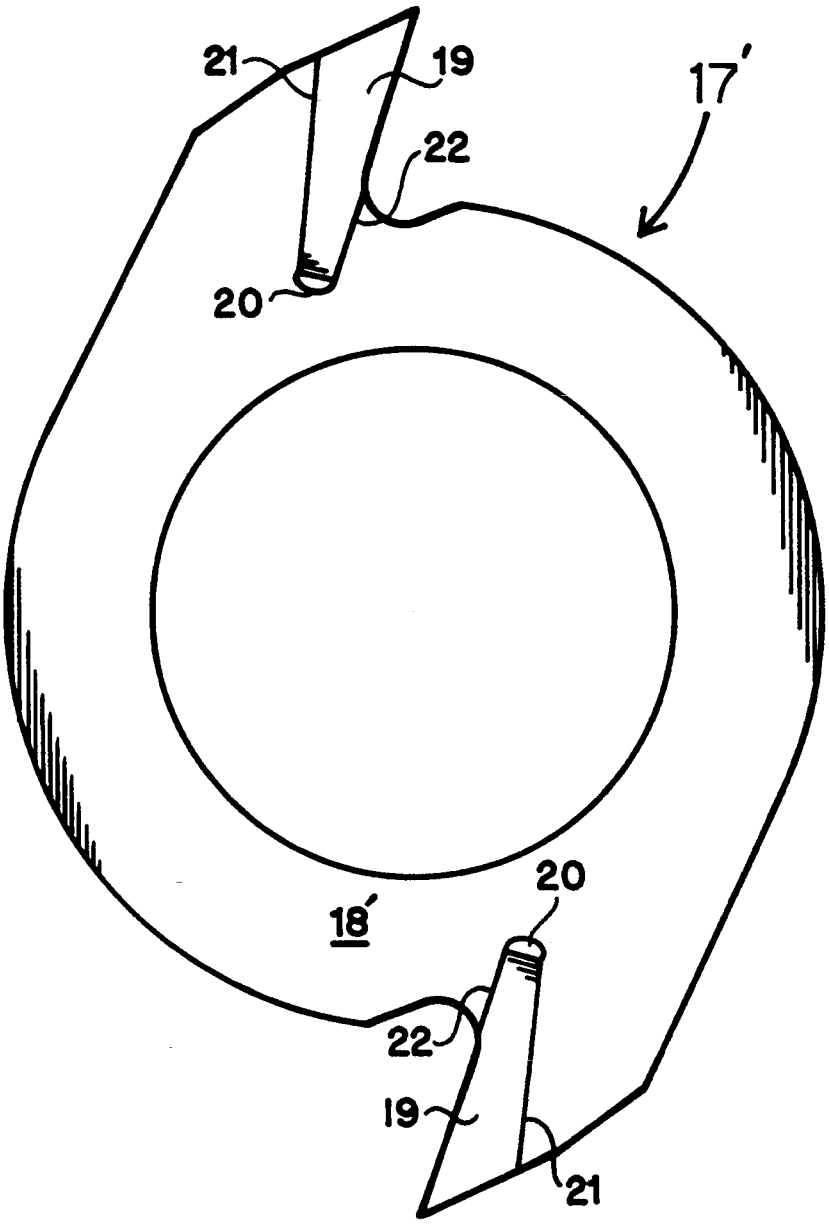
FIG. 8 is a first side view of a second embodiment of the invention having two cutter tips attached to a single blade member.
Figure 9:
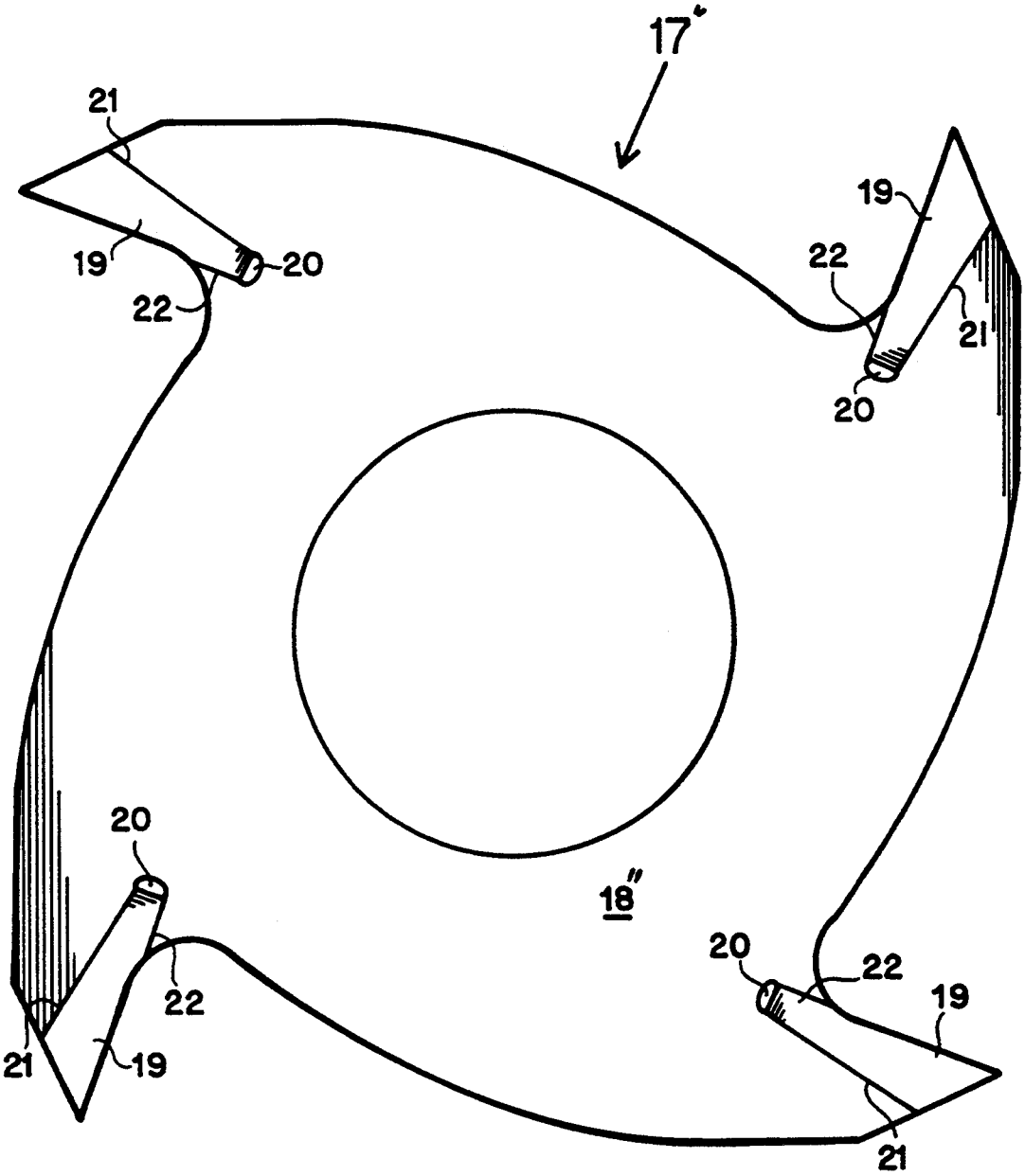
FIG. 9 is a first side view of a third embodiment of the invention having four cutter tips attached to a singe blade member.

FIG. 8 shows a second embodiment of the invention, here designated as 17'. Cutter blade 17' has a pair of cutter tips 19 diametrically attached to a generally annular backing member 18' using the same cantilever pocket attachment system. Cutter blades 17' are designed to be attached around the shaper spindle and may be stacked one on top of another to form multiple finger joint grooves, as well as being radially staggered to reduce the intermittent cutting vibration. It should be apparent that more than two cutter teeth 19 can be attached to the annular backing member 18'. For instance, FIG. 9 shows a third embodiment of the present invention where cutter blade 17'' includes four cutter teeth 19.

While there is shown and described the present preferred embodiment of the invention, it is to be distinctly understood that this invention is not limited thereto but may be variously embodied to practice within the scope of the following claims.

I claim:

1. A cutter head for finger joint cutting which comprises:

an arbor collar for attachment to a spindle of a shaping apparatus;

a top plate being radially attached to the arbor collar;

a bottom plate being radially attached to the arbor collar in parallel spaced relation to the top plate;

a plurality of cutter blades being annularly attached around the arbor collar between and to the top and bottom plates, where each of the cutter blades includes a backing member having a cutter tip attachment surface thereon, the backing member including a cantilever pocket formed therein which includes a pair of side surfaces, one of which is co-extensive with the attachment surface; and a plurality of cutter tips, each of which being attached to the attachment surface on one of the cutter blade backing members, each cutter tip having a portion thereof extending into the cantilever pocket in the backing member and being attached to both side surfaces of the pocket.

2. The cutter head of claim 1 wherein the cutter tips are attached to the backing members at the attachment surfaces and pocket side surfaces using a sandwich braze.

3. The cutter head of claim 2 wherein the cutter tips are formed from tungsten carbide.

4. The cutter head of claim 1 wherein the cutter tips are formed from tungsten carbide.

5. The cutter head of claim 4 wherein the side surfaces of the cantilever pocket diverge outwardly from a rounded vertex and the cutter tips are shaped so that the portions thereof which extend into the cantilever pockets closely match the shape of the pockets.

6. The cutter head of claim 3 wherein the side surfaces of the cantilever pocket diverge outwardly from a rounded vertex and the cutter tips are shaped so that the portions thereof which extend into the cantilever pockets closely match the shape of the pockets.

7. The cutter head of claim 2 wherein the side surfaces of the cantilever pocket diverge outwardly from a rounded vertex and the cutter tips are shaped so that the portions thereof which extend into the cantilever pockets closely match the shape of the pockets.

8. The cutter head of claim 1 wherein the side surfaces of the cantilever pocket diverge outwardly from a rounded vertex and the cutter tips are shaped so that the portions thereof which extend into the cantilever pockets closely match the shape of the pockets.

9. A finger joint cutter blade which comprises:

a backing member having a cutter tip attachment surface thereon, the backing member including a cantilever pocket formed therein which includes a pair of side surfaces, one of which is co-extensive with the attachment surface; and a cutter tip being attached to the attachment surface on the cutter blade backing member, the cutter tip having a portion thereof extending into the cantilever pocket in the backing member and being attached to both side surfaces of the pocket.

10. The cutter head of claim 9 wherein the cutter tips are attached to the backing members at the attachment surfaces and pocket side surfaces using a sandwich braze.

11. The cutter head of claim 10 wherein the cutter tips are formed from tungsten carbide.

12. The cutter head of claim 9 wherein the cutter tips are formed from tungsten carbide.

13. The cutter head of claim 12 wherein the side surfaces of the cantilever pocket diverge outwardly from a rounded vertex and the cutter tips are shaped so that the portions thereof which extend into the cantilever pockets closely match the shape of the pockets.

14. The cutter head of claim 11 wherein the side surfaces of the cantilever pocket diverge outwardly from a rounded vertex and the cutter tips are shaped so that the portions thereof which extend into the cantilever pockets closely match the shape of the pockets.

15. The cutter head of claim 10 wherein the side surfaces of the cantilever pocket diverge outwardly from a rounded vertex and the cutter tips are shaped so that the portions thereof which extend into the cantilever pockets closely match the shape of the pockets.

16. The cutter head of claim 9 wherein the side surfaces of the cantilever pocket diverge outwardly from a rounded vertex and the cutter tips are shaped so that the portions thereof which extend into the cantilever pockets closely match the shape of the pockets.

* * * * *